US007070180B2

(12) United States Patent
Lindenmayer et al.

(10) Patent No.: US 7,070,180 B2
(45) Date of Patent: Jul. 4, 2006

(54) METHOD AND DEVICE FOR STACKING FLAT MAILINGS

(75) Inventors: Bernd Lindenmayer, Bodmann Ludwigshafen (DE); Dietmar Oexle, Singen (DE); Rolf-Peter Skrdlant, Constance (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/995,825

(22) Filed: Nov. 24, 2004

(65) Prior Publication Data

US 2005/0189270 A1 Sep. 1, 2005

Related U.S. Application Data

(63) Continuation of application No. PCT/DE03/01339, filed on Apr. 24, 2003.

(30) Foreign Application Priority Data

May 25, 2002 (DE) ..... 102 23 349

(51) Int. Cl.
*B65H 43/04* (2006.01)

(52) U.S. Cl. ..... 271/215; 271/201; 271/214

(58) Field of Classification Search ..... 271/201, 271/214, 215, 223, 181; 209/583
See application file for complete search history.

(56) References Cited

U.S. PATENT DOCUMENTS

| | | | | |
|---|---|---|---|---|
| 3,918,704 A | | 11/1975 | Sugiyama et al. | |
| 4,951,934 A | * | 8/1990 | Prins | 271/181 |
| 5,221,080 A | * | 6/1993 | Ricciardi | 271/214 |
| 5,224,697 A | * | 7/1993 | Darchis et al. | 271/201 |
| 5,253,859 A | * | 10/1993 | Ricciardi | 271/176 |
| 6,588,743 B1 | * | 7/2003 | Yap | 271/215 |

FOREIGN PATENT DOCUMENTS

| | | |
|---|---|---|
| DE | 1235818 | 3/1967 |
| DE | 2714520 A1 | 10/1978 |
| DE | 19547292 A1 | 6/1997 |
| JP | 08113410 | 5/1996 |
| JP | 08259080 | 10/1996 |

OTHER PUBLICATIONS

Derwent Abstract—DE2714520; Oct. 12, 1978; Licentia Patent-Verwaltungs-GmbH, D-6000 Frankfurt (Germany).
Derwent Abstract—DE19547292A1; Jun. 26, 1997; AEG Electrocom GmbH; D-78467 Konstanz (Germany).
Derwent-Abstract—DE1235818; Mar. 2, 1967; Telefunken Patentverwertungsgesellschaft m.b.H.; Elisabethenstrasse 3, D-Ulm/Donau (Germany).
EP-Abstract-JP-08259080; Oct. 8, 1996; Dainippon Printing Co. Ltd. (Japan).

* cited by examiner

*Primary Examiner*—Donald P. Walsh
*Assistant Examiner*—Kaitlin Joerger
(74) *Attorney, Agent, or Firm*—Siemens AG; Jacob Eisenberg

(57) ABSTRACT

The present invention relates to a method and a device for stacking flat mailings, in which the thickness of each individually conveyed mailing that is to be stacked is detected within a main control loop. The underfloor belt is displaced away from the stacking location by a distance that corresponds to the measured thickness minus a specific distance by means of a stack support for the arriving mailing. The stacking force is measured at different heights in the area of the stacking roll in a static correcting control loop and is re-regulated by moving the underfloor belt within set point values established for the allowed stacking force ranges once each mailing has reached the stop.

7 Claims, 2 Drawing Sheets

METHOD AND DEVICE FOR STACKING FLAT MAILINGS

CROSS REFERENCE TO RELATED APPLICATIONS

The present application is a continuation of international application PCT/DE03/01339, filed on Apr. 24, 2003, which designated the United States and was pending at the time of designation and the filing of the present application; and further claims priority to German patent application 10223349.7, filed May 25, 2002; the both of which are herein incorporated by reference.

BACKGROUND OF THE INVENTION

The present invention relates to a method and a device for stacking flat mailings, the mailings including differences with respect to their format (length, height), their thickness, and their stiffness. Flexible and stiff mailings in large and small formats (e.g.: DIN B4 and small postcards) should be capable of being processed both separately and in a mixture. The mailings of different length, height, thickness and stiffness are transported as individual mailings with a minimum spacing in covering belts and, for the purpose of further processing or for storage, should be aligned in the stack exactly on two edges (front and lower edge).

A method and a device for stacking flat mailings is disclosed in DE 27 14 520 A1, wherein an underfloor belt and a stack support detachably connected to the latter being moved away from the stacking point as the stack grows, and the mailings transported to a stacking point by a covering belt system being moved to a stop by means of stacking belts and a stacking roll, forming a stack.

A solution was known in which a mechanical limit switch is located directly in front of the stacking roll underneath the stacking belt, projecting geometrically into the stream of letters, and is thus pressed when a mailing moves past it. This limit switch outputs the signal to a driven underfloor belt to move the underfloor belt as long as the switch is pressed. Since the switch is arranged underneath the belt, it is able to detect only the lower region of a mailing. Depending on the skewed position of a mailing, the switch is not touched at all and thus does not output any movement signal to the underfloor belt and, in the other case, the mailing presses permanently on the switch, the underfloor belt moves, together with the mailing, away from the stacking roll, until the switch has reached its initial position again. This type of switch reacts only to a defined stacking force. It is not able to react to the individually detected specifically different mailings. Thus, for all the different types of mailing, there is only a single stacking force within the stack, which is not optimal for all types of mailing.

JP 08 259 080 AA discloses the fact that, during stacking, an exact alignment can be achieved if the stack is moved away from the stacking point on the basis of the thickness of the objects, and the speed of this movement is corrected on the basis of stacking forces measured at a plurality of points at the stacking point. JP 08 113 410 AA also teaches controlling this movement on the basis of the thickness and of the stacking force. The goods to be stacked in this case exhibit great differences with regard to their size, thickness and condition.

Furthermore, devices for intermediately stacking mailings were known in which the control for moving a stack support is carried out on the basis of a force measurement (DE 1 235 818 A, DE 195 47 292 A) or on the basis of a force and thickness measurement in the case of mailings with relatively small size and thickness differences (U.S. Pat. No. 3,918,704 A).

SUMMARY OF THE INVENTION

The invention is therefore based on the object of providing a method and a device for stacking flat mailings in which, even in the event of relatively large format and thickness differences, an optimal stacking force is generated for each mailing to be stacked, so that each mailing reaches the stop with the least possible stacking noise, and its front edge and its lower edge are aligned exactly in a line with the mailings already stacked.

According to the invention, the object is achieved by the features of claims 1 and 4.

In addition to the thickness, the height and length of each mailing is measured as the mailing format. After the thickness of each mailing supplied individually and to be stacked has been determined within the main control loop and the underfloor belt with the stack support for the incoming mailing has been moved away from the stacking point by this amount of the measured thickness minus a specific amount, then, in a correction control loop, after the respective mailing has reached the stop, the stacking forces are measured at various heights in the region of the stacking roller by means of force sensors and, by means of moving the underfloor belt with the stack support, are readjusted within the context of defined threshold values for the permissible stacking force ranges.

The stacking device also has a control unit which is connected to the format measuring device, the thickness measuring device, the drives of the underfloor belts and the force sensors and which ensures the following sequence for each stacking compartment:

- measurement of the height and of the length of the mailing to be stacked,
- measurement of the thickness of the mailing to be stacked,
- movement of the underfloor belt away from the stacking point by the measured thickness value minus a specific amount,
- measurement of the stacking forces on the force sensors after the mailing has reached the stop, only the force sensors within the height of the mailing being evaluated,
- if specific threshold values with respect to height and/or number and/or duration are overshot on specific force sensors, movement of the underfloor belt with the stack support away from the stacking roll in accordance with the type of overshoots, so that the necessary stacking conditions are produced.

The force sensors to be evaluated, together with their position, the type of overshoots (overshoots for a time, height and number of overshoots) are determined in a prior test phase for each mailing format on the basis of statistical investigations from corresponding defined threshold values the movement of the underfloor belt. The optimal stacking force for each mailing has the effect not only that the mailings, which from time to time are highly different, are stacked so as to be aligned accurately, but also that the energy of the mailing to be stacked is largely dissipated, which means that the stacking noise is reduced.

Advantageous refinements of the invention are presented in the subclaims.

It is also advantageous to determine the amount to be subtracted from the measured thickness for careful edge alignment of the stack in the prior test phase for each mailing format on the basis of statistical investigations.

It is also advantageous, in the test phase, additionally to define the amount to be subtracted from the measured thickness on the basis of mailing stiffnesses determined by means of a measuring arrangement. For example, stiff mailings tend to be less compressible, so that the amount to be subtracted from the thickness must be reduced.

In order that, in the event of a pause in the supply of mailings, the last mailing is not subjected for too long to a high friction loading on the rotating stacking roll and the moving stacking belt and possibly damaged as a result, the control unit is advantageously designed such that, if a defined time interval is overshot within which no mailings are led into the stacking compartment, the underfloor belt with the part stack held by the stack support is moved away from the stacking roll and the stacking belt until the measured values of the force sensors are so low that the rotating stacking roll and the moving stacking belt do not damage the last mailing. Shortly before the next mailing enters the stacking compartment, the underfloor belt with the part stack is moved toward the stacking roll until the defined stacking forces are reached again.

BRIEF DESCRIPTION OF THE SEVERAL VIEWS OF THE DRAWINGS

The invention will next be explained in more detail in an exemplary embodiment by using the drawing, in which.

DETAILED DESCRIPTION OF THE INVENTION

Figure 1:
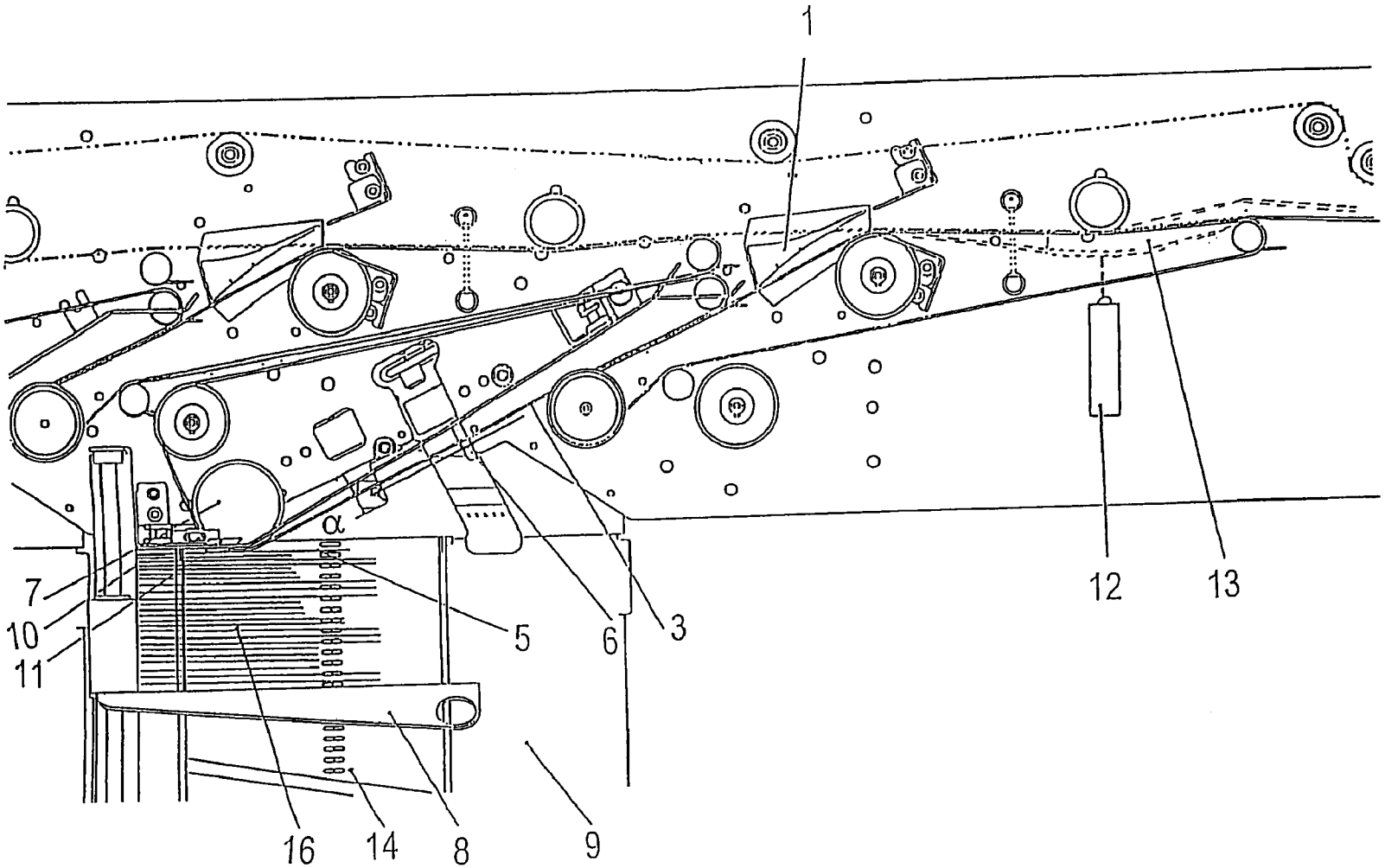
FIG. 1 shows a plan view of the stacking device with a stacking compartment.
Figure 2:
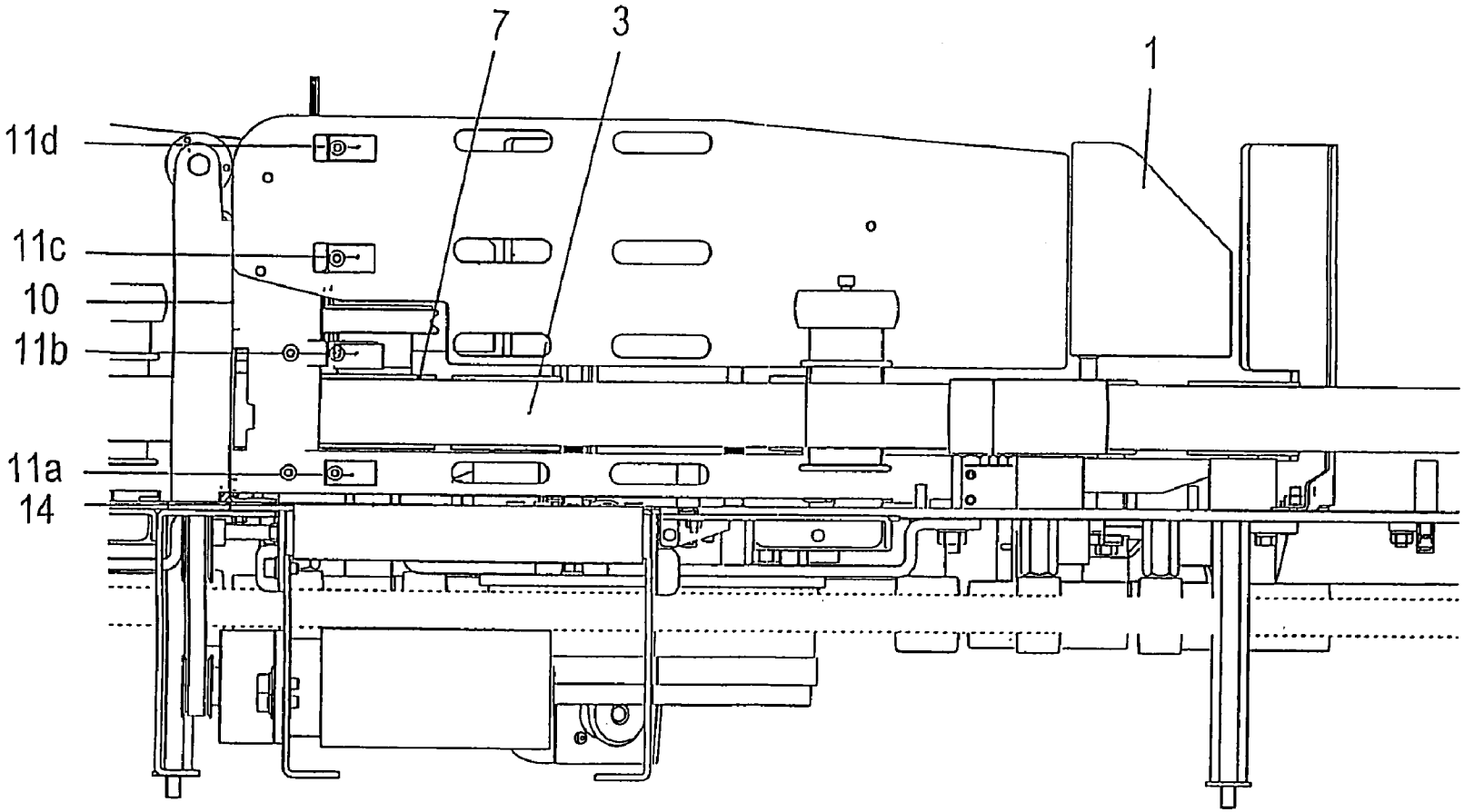
FIG. 2 shows a side view seen from the stack support, without a stack.

A stack 16 is formed in that, at the inlet to a stacking compartment 9, in each case a following mailing strikes the preceding mailing at an angle $\alpha$ and slides on said mailing as far as a stop 10, by means of which it is stopped.

Between a stacking roll 7 and the stack 16 there are forces which have to be overcome by a mailing to be stacked in order to reach the stop 10.

Arranged in front of the stacking device, in the course of the letters, is a thickness sensor 12, which measures the mailing thickness of the mailing 13 that has just moved past. If the mailing 13 is deflected into the stacking compartment 9 with the aid of a diverter 1, an underfloor belt 14, which has a releasable form-fitting connection to a stack support 8, is moved a certain distance away by a control drive (on the basis of the measured mailing thickness). Thus, sufficient space is created between the stacking roll 7 and the mailing 6 already stacked, into which space it is possible to push the following mailing 13, that is to say the underfloor belt 14 does not have to move by the thickness value exactly determined but, depending on the type of mailing, such as, for example, short or long, low or high, flexible or stiff, only by a differential amount of the thickness value, in order that a force is built up again within the stack 16 as soon as the mailing 13 is located between stacking roll 7 and stack support 8. Thus, only coarse setting of the stacking force is carried out with the aid of the thickness sensor 12.

The fine setting of the stacking force is carried out via at least one or more force sensors 11 (in the example 11*a, b, c* and *d*). These force sensors 11 are arranged in the vicinity of the stacking roll 7, offset vertically such that the force sensors 11 can all detect mailings of different height. Since the gap between stacking roll 7 and the stack support 8 is smaller than the sum of the individual thicknesses of the loose flat mailings on the stack 16, a stacking force is built up within the stack 16. Depending on the height of the mailing 5, this then presses on one or more force sensors 11, which register corresponding force values.

In combination with the format monitoring, which has determined the type of mailing (such as, for example, short or long, low or high, flexible or stiff mailing), the optimum threshold value of the stacking force is predefined to the individual force sensors 11, in order to create optimum conditions for the mailing 6 to be stacked, in order that the latter can be stacked exactly on the conveying and lower edges. The force exerted by the stacked mailing 6 on the force sensors 11 is compared with the threshold values. Depending on the result, the stack 16 is then compressed or pulled apart by moving the underfloor belt 14, in order to produce the optimum conditions again for a following mailing 6.

If no mailing is stacked in the stacking compartment 9 for a relatively long time, the stack 16 is transported by means of moving the underfloor belt 14 until the measured force values from the force sensors 11 result in sufficiently low values which permit it to be concluded that the mailing 5 is no longer standing in line on the stacking belt 3 which leads the mailings to the stacking roll 7. Thus, the mailing 5 is no longer subjected to the high frictional loading of the permanently rotating stacking belt 3. Damage to the mailing is thus avoided.

Before the next mailing 6 arrives, the requisite stacking conditions are produced again by moving the underfloor belt 14 back.

By means of the programmable sensor control, in principle an extremely wide range of parameters can be set:

- All the force sensors 11 can have different threshold values and different logical combinations predefined.
  - The underfloor belt 14 is driven only if a threshold value is overshot in all the force sensors 11,
  - if the set value is overshot only in one force sensor 11,
  - if the values are overshot in a plurality of force sensors 11.
- The threshold values of the various force sensors 11 are set individually to each type of mailing, depending on mass, thickness and stiffness and format.
- Depending on the type of mailing, the force sensors 11 are allotted a time-dependent force evaluation, that is to say the incoming mailing 5 must, for example, transmit a force for a defined period and at a defined time to the force sensor or sensors 11, in order that they output the signal for the forward movement of the underfloor belt 14. Brief peak loadings are therefore suppressed.
- The signal for the forward movement can also be defined on the basis of the number of measurements within a time interval and/or the number of times the threshold values are overshot.

In a prior test phase for each mailing format, the amount to be subtracted from the measured thickness for careful edge alignment of the stack 16, and the force sensors 11 to be evaluated and also their threshold values are determined on the basis of statistical investigations.

Examples of Mailings to Be Stacked:

1. Thin Low Mailing (e.g. Postcard):
   The thickness sensor 12 registers a mailing which is thinner than 2 mm and therefore issues no movement command to the underfloor belt 14. Therefore, no gap is to be produced between the stacking roll 7 and the last mailing 5 stacked. An upstream height monitor has registered the fact that the mailing 6 to be stacked is a low mailing and therefore only the values from the force sensors 11*a* and 11*b* are to be used for underfloor belt control.

The low and thin mailing moves past the thickness sensor 12. The underfloor belt 14 does not receive any signal to create a gap between the stacking roll 7 and the stack 16. Once the mailing has reached the stop 10, the force sensors 11*a* and 11*b* determine the force. If one of the two values determined overshoots 2 N, then the underfloor belt 14 moves through the defined distance, so that the necessary stacking conditions are produced.

2. 8 mm Thick B4 Format Mailing:

The thickness sensor registers a mailing which is thicker than 2 mm and therefore issues a movement command to the underfloor belt 14. A gap is therefore to be produced between the stacking roll 7 and the stack 16 before the mailing to be stacked has reached the stacking roll 7. However, the underfloor belt 14 moves only by the amount of the thickness of the mailing minus 2 mm, in order to generate a positive force for the mailing to be stacked. An upstream height monitor has registered the fact that the mailing to be stacked is a high mailing and therefore also the values from all the force sensors 11*a* to 11*d* are to be used for underfloor belt control.

The high and 8 mm thick mailing moves past the thickness sensor 12. The underfloor belt 14 receives the signal to move 6 mm, in order to create a 6 mm wide gap between the stacking roll 7 and the foremost mailing 5 of the stack 16.

Once the mailing has reached the stop 10, the force sensors 11*a* to 11*d* determine the force. If one of the four values determined overshoots 4 N, then the underfloor belt 14 moves through the defined distance, so that the necessary stacking conditions are produced.

What is claimed is:

1. A method for stacking flat mailings having stacking compartments comprising an underfloor belt and a stack support releasably coupled thereto, wherein the mailings are stacked standing upright, the underfloor belt and the stack support with growing stack are moveably displaceable away from the stacking point, the mailings transported in one after another are moved to a stop with an aid of a stacking roll thereby forming a stack, movement of the underfloor belt and the stack support away from the stacking point is carried out on the basis of a measured thickness of each mailing supplied and to be stacked and according to the stacking forces measured by force sensors at different heights in the region of the stacking roll, comprising the steps of:

measuring a height and length of a mailing to be stacked, measuring a thickness of the mailing;

moving the underfloor belt with the stack support away from the stacking point by an amount substantially equal to the measured thickness less a specific amount;

after the mailing has reached the stop, measuring the stacking forces in the region of the stacking roll;

in a correction control loop, in accordance with a type of overshoots with respect to at least one of height, number and duration from predefined threshold values, moving the underfloor belt with the stack support in order to maintain defined stacking conditions; and preevaluating the force sensors, a type of evaluation and threshold values in a prior test phase for each mailing format on a basis of statistical investigations.

2. The method according to claim 1, wherein an amount to be subtracted from the measured thickness for careful edge alignment of the stack is defined in a prior test phase for each mailing format on the basis of statistical investigations.

3. The method according to claim 2, wherein, in the test phase, the amount to be subtracted from the measured thickness is additionally defined on a basis of mailing stiffnesses determined by means of a measuring arrangement.

4. A device for stacking flat mailings by using a thickness measuring device in which a thickness of each mailing supplied individually and to be stacked is determined, comprising:

stacking compartments including;

an underfloor belt driven under control and a stack support releasably coupled thereto, means for accomodating mailings stacked standing upright, means for displacing the underfloor belt and the stack support with growing stack with respect to a stacking point wherein the mailings, transported in one after another, are transported to a stop with the aid of a stacking roll thereby forming a stack (16), a measuring device arranged on a mailing moving plane proximate to the stacking roll, and a plurality of force sensors vertically offset and arranged to determine stacking forces, a format measuring device for measuring height and length of each mailing; and a control unit connected to the thickness measuring device, the format measuring device, drives of the underfloor belts and the force sensors and for each stacking compartment, comprising:

means for effecting measurement of a height and length of each mailing to be stacked, means for effecting measurement of the thickness of a mailing to be stacked, means for effecting movement of the underfloor belt with the stack support away from the stacking point by the measured thickness value minus a specific amount, means for effecting measurement of the stacking forces on the force sensors after the mailing has reached the stop, and if defined threshold values with respect to at least one of height, number, and duration are overshot on specific force sensors, means for effecting movement of the underfloor belt with the stack support away from the stacking roll, so that defined stacking conditions are produced, the force sensors to be evaluated and their threshold values being defined in a prior test phase for each mailing format on a basis of statistical investigations.

5. The device according to claim 4, wherein an amount to be subtracted from the measured thickness for select edge alignment of the stack is defined in a prior test phase for each mailing format on the basis of statistical investigations.

6. The device according to claim 4, wherein, in the test phase, an amount to be subtracted from measured thicknesses and threshold values of the force sensors are additionally defined according to mailing stiffnesses determined by a measuring arrangement.

7. The device according to claim 4, wherein the control unit further comprises means for, if a defined time interval is overshot within which no mailings are led into the stacking compartment, moving the underfloor belt with the part stack held by the stack support away from the stacking roll until the rotating stacking roll and moving supply means do not damage a last mailing, and the control means further comprises means for, shortly before a next mailing enters the stacking compartment, moving the underfloor belt with the part stack toward the stacking roll until the defined stacking conditions are reached.

* * * * *